US009598908B2

(12) United States Patent
Ramasamy et al.

(10) Patent No.: US 9,598,908 B2
(45) Date of Patent: Mar. 21, 2017

(54) MULTILAYER COATING PROCESS PROTECTING THE SUBSTRATE OF THERMALLY STABLE POLYCRYSTALLINE DIAMOND CUTTER

(71) Applicant: DIAMOND INNOVATIONS, INC, Worthington, OH (US)

(72) Inventors: Ramamoorthy Ramasamy, Westerville, OH (US); Thomas Dugan, New Albany, OH (US); Mark Schweizer, Powell, OH (US)

(73) Assignee: DIAMOND INNOVATIONS, INC, Worthington, OH (US)

( * ) Notice: Subject to any disclaimer, the term of this patent is extended or adjusted under 35 U.S.C. 154(b) by 178 days.

(21) Appl. No.: 14/571,577

(22) Filed: Dec. 16, 2014

(65) Prior Publication Data

US 2015/0167396 A1 Jun. 18, 2015

Related U.S. Application Data

(60) Provisional application No. 61/916,362, filed on Dec. 16, 2013.

(51) Int. Cl.

| | |
|---|---|
| ***E21B 10/56*** | (2006.01) |
| ***E21B 10/567*** | (2006.01) |
| ***B24D 3/00*** | (2006.01) |

(52) U.S. Cl.

CPC ..... *E21B 10/567* (2013.01); *B24D 3/005* (2013.01); *E21B 10/56* (2013.01); *E21B 2010/561* (2013.01)

(58) Field of Classification Search

USPC ..... 216/41, 47, 49; 428/332, 408, 422, 698; 427/407.1

See application file for complete search history.

(56) References Cited

U.S. PATENT DOCUMENTS

| | | | | |
|---|---|---|---|---|
| 4,104,344 | A | 8/1978 | Pope | |
| 4,224,380 | A | 9/1980 | Bovenkerk et al. | |
| 6,450,271 | B1 * | 9/2002 | Tibbitts | E21B 10/52 175/374 |
| 7,712,553 | B2 | 5/2010 | Shamburger | |
| 7,757,792 | B2 | 7/2010 | Shamburger | |

(Continued)

*Primary Examiner* — Archene Turner
(74) *Attorney, Agent, or Firm* — Corinne R. Gorski

(57) ABSTRACT

A method for making a polycrystalline diamond compact including the step of providing a polycrystalline diamond compact. The compact has a substrate of a hard metal composition of material and a volume of diamond material disposed on the substrate. The diamond material includes a mixture of diamond particles and a binder-catalyst. At least one pre-coating layer of organic material impermeable to a given acid or mixture of given acids is applied to at least an exterior surface of the substrate. At least one layer of primer material that is impermeable to a given acid or mixture of given acids is applied on the at least one pre-coating layer. A layer of top coating material that is impermeable to the given acid or mixture of given acids is applied to the at least one primer layer. When the given acid or mixture of given acids is applied to the compact to leach the binder-catalyst from the diamond material the at least one pre-coating layer, at least one primer layer and layer of top coating material protect the coated portions of the compact.

28 Claims, 5 Drawing Sheets

(56) References Cited

U.S. PATENT DOCUMENTS

2012/0151847 A1* 6/2012 Ladi ..... C22B 3/44
51/307
2012/0247841 A1 10/2012 Tessitore

* cited by examiner

MULTILAYER COATING PROCESS PROTECTING THE SUBSTRATE OF THERMALLY STABLE POLYCRYSTALLINE DIAMOND CUTTER

RELATED APPLICATION DATA

This application claims priority to U.S. Provisional Patent Application No. 61/916,362, filed on Dec. 16, 2013, which the entirety thereof is incorporated herein by reference.

TECHNICAL FIELD AND INDUSTRIAL APPLICABILITY

The present disclosure relates to a method of making a polycrystalline diamond compact, and more particularly to a multilayer coating process for protecting the substrate of a polycrystalline diamond cutter during a leaching process.

SUMMARY

In one aspect, a method for making a polycrystalline diamond compact is disclosed including the step of providing a polycrystalline diamond compact, the compact having a substrate of metal carbide and a volume of diamond material disposed on the substrate. At least one pre-coating layer of organic material impermeable to a given acid or mixture of given acids is applied to at least an exterior surface of the substrate. At least one layer of primer material that is impervious to a given acid or mixture of given acids is applied on the at least one pre-coating layer. A layer of top coating material that is impermeable to the given acid or mixture of given acids is applied to the at least one primer layer.

In another aspect, an embodiment of a polycrystalline diamond compact according to the present disclosure includes a substrate of metal carbide, the substrate having an exterior surface. A volume of diamond material is disposed on the substrate. At least one layer of a protective pre-coating impermeable to a given acid or mixture of given acids is disposed on an entire exterior surface of the substrate and selected portions of the volume of diamond material. At least one layer of primer material that is impermeable to a given acid or mixture of given acids is disposed on the at least one protective pre-coating entire exterior surface of the substrate and selected portions of the volume of diamond material. A layer of top coating material that is impermeable to the given acid or mixture of given acids is disposed on the at least one primer layer, These and other objects, features, aspects, and advantages of the present disclosure will become more apparent from the following detailed description of the preferred embodiment relative to the accompanied drawings, in which:

DETAILED DESCRIPTION

Polycrystalline diamond (PCD) compacts have a well-known use in industrial applications, such as drilling and/or cutting. As used herein, a PCD refers to a polycrystalline diamond that has been formed under high pressure, high temperature (HPHT) conditions. These compacts typically include polycrystalline diamond particles bonded into a coherent hard conglomerate. The diamond particle content of the compacts is high and there is an extensive amount of direct particle-to-particle bonding.

The compacts are made under HPHT conditions at which the abrasive particle is crystallographically stable. PCD compacts are most often formed by sintering diamond powder with a suitable binder-catalyzing by placing a cemented carbide substrate into the container of a press. A mixture of diamond particles or grains and binder-catalyst is placed atop the substrate and compressed under high HPHT conditions. In so doing, metal binder migrates from the substrate and sweeps through the diamond grains to promote a sintering of the diamond grains. As a result, the diamond grains become bonded to each other to form a diamond layer, and that diamond layer is bonded to the substrate along a planar or non-planar interface. Metal binder remains disposed in the diamond layer within pores defined between the diamond grains.

Figure 1:
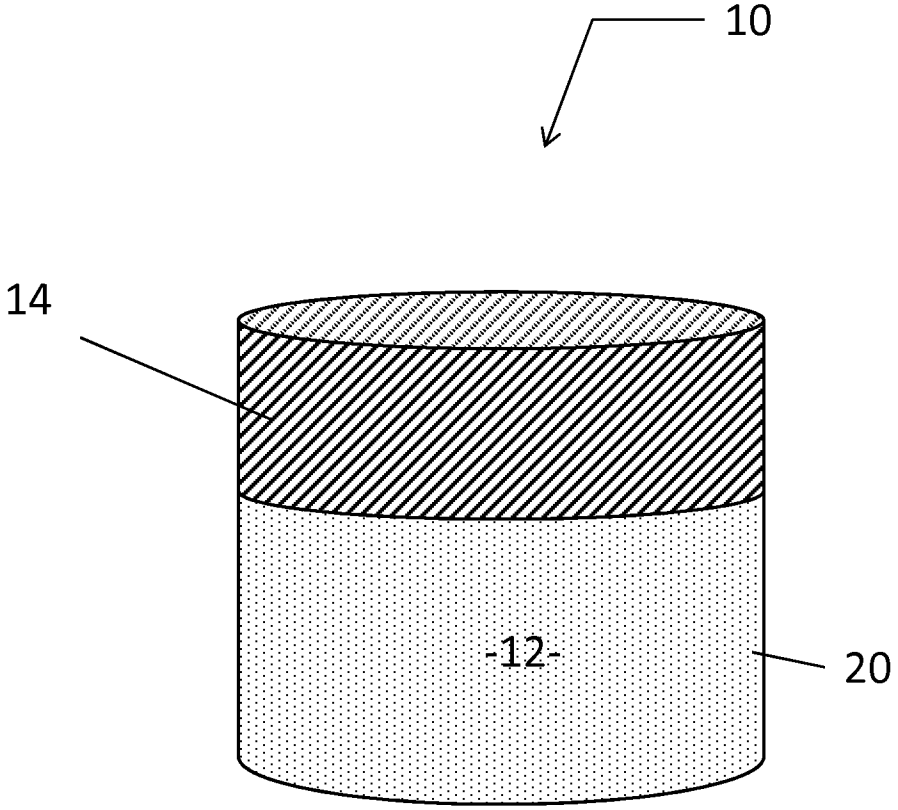
FIG. 1 is a perspective view of a PCD compact.

Referring to FIG. 1, a polycrystalline diamond compact 10 includes a substrate 12, preferably comprised of a hard metal composition and a bed or abrasive outer layer or volume 14 of diamond particles or grains and binder-catalyst disposed on substrate 12. A hard metal composition is a composite material normally having a hard phase composed of one or more carbides, nitrides or carbonitrides of tungsten, titanium, chromium, vanadium, tantalum, niobium (or similar) bonded by a metallic phase typically cobalt, nickel, iron (or combinations) or similar in varying proportions. Substrate 12 is preferably a cobalt bonded tungsten carbide (Co-WC) substrate. However, it should be appreciated that other metal carbide materials can be used for the substrate. A volume of diamond material is a mixture of diamond particles and a binder-catalyst.

The completed PCD compact is an interconnected mutually exclusive network of two phases. The majority phase is diamond grains or particles bonded to each other with many interstices and a minority phase of non-diamond binder-catalyst material, as described above, typically metal. As defined herein, an interconnected mutually exclusive network of particles is a network of particles wherein the diamond grains or particles are sintered together to form a continuous diamond structure.

Figure 2:
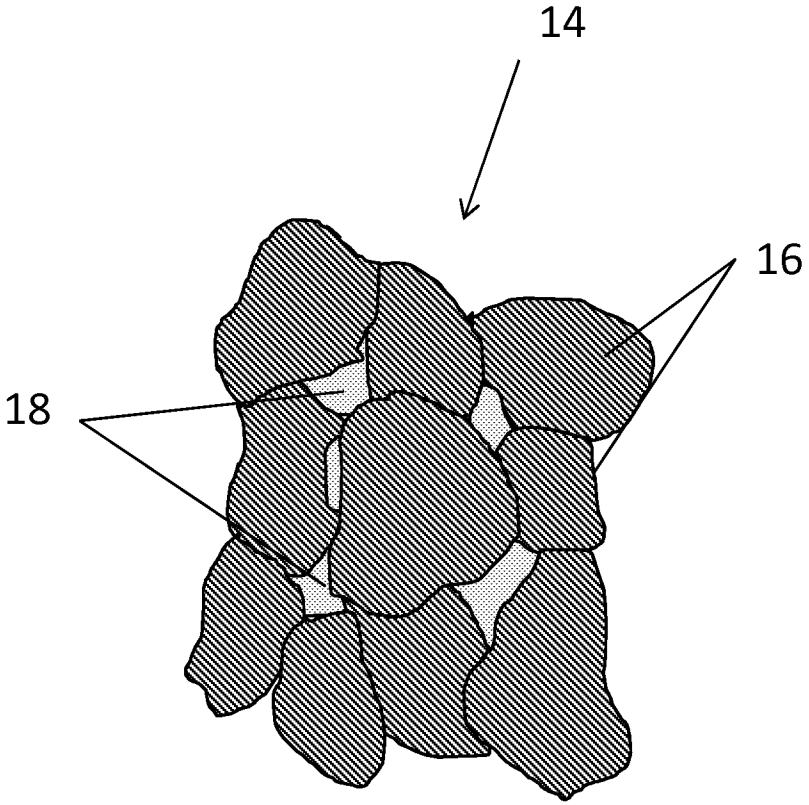
FIG. 2 is an enlarged view of the diamond structure of the PCD compact.

As shown in FIG. 2, the majority phase of diamond grains or particles 16 forms diamond-to-diamond bonds. A volume of residual binder-catalyst metal 18, the minor phase, may be disposed in interstices between the diamond grains or particles. Although cobalt is most commonly used as the binder-catalyzing material, cobalt, nickel, silicon, boron, zirconium, aluminum, ruthenium, chromium, manganese, molybdenum, platinum, palladium, alloys and/or combinations of such can be used.

In the PCD compacts, the presence of the binder-catalyzing material in the interstitial regions adhering to the diamond particles leads to thermal degradation. Heat generated during use causes thermal damage to the PCD compact due to the difference in thermal expansion coefficients between the diamond particles, binder-catalyst material and the substrate. To reduce thermal degradation, polycrystalline diamond compacts have been produced as preform PCD elements for cutting and/or wear resistant elements, as disclosed in U.S. Pat. No. 4,224,380. In one type of the disclosed PDC compact, the cobalt or other binder-catalyzing material is leached out from the continuous interstitial matrix after formation. While this may increase the temperature resistance of the diamond structure, the leaching process also removes a substantial amount of the cemented carbide substrate. Because there is no substantial substrate or other bondable surface, difficulties arise when mounting the compacts and also during use in operation.

Leaching out the catalyst metal component from polycrystalline diamond cutters and tools, require precise protection of carbide and other substrates. Accordingly, different methods and means have been proposed to coat the diamond crystal bed and/or the carbide substrate. See U.S. Pat. Nos. 7,712,553 and 7,757,792.

Known bulk mechanisms for protecting substrates during a leaching process are cumbersome and limit flexibility and capacity. Thus, there is a need for leaching method that miniaturizes the protection schemes of the substrate.

Figure 3:
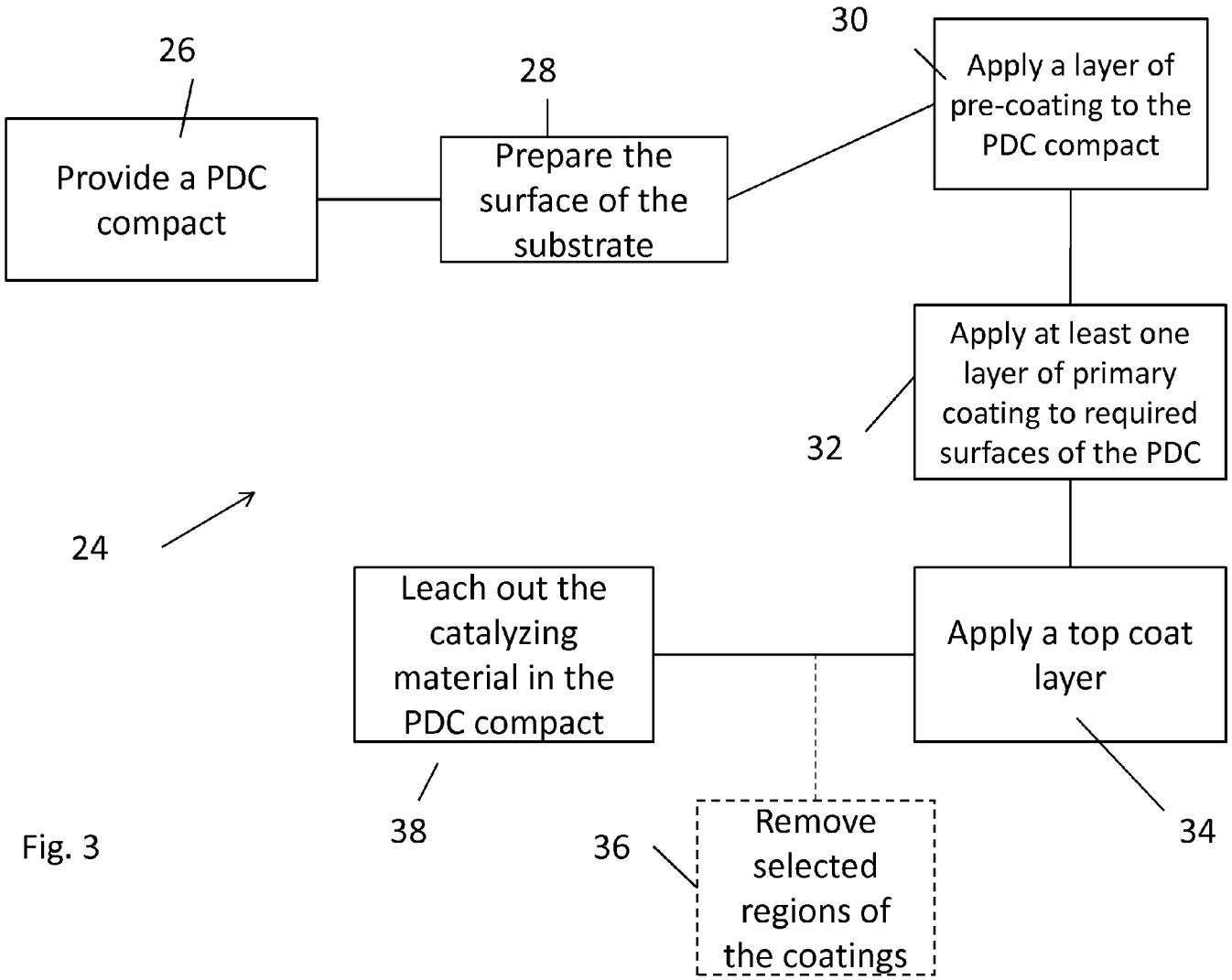
FIG. 3 is a flow diagram of the steps of a method of the present disclosure.

Referring to FIG. 3, the method 24 of the present disclosure includes the step 26 of providing a PCD compact 10. As described above, compact 10 has a substrate of metal carbide 12 and a volume of diamond material 14 disposed on the substrate, the volume of diamond material is defined herein as including a mixture of diamond particles 16 and a binder-catalyst 18.

Referring again to FIG. 1, a surface 20 of substrate 12 that is to be protected from a given acid or mixture acids during the leaching process, as described further herein, can be prepared by grid blasting, alcohol rinsing, or any other appropriate surface treatment in step 28 (FIG. 3) to improve adhering of the coating layers thereto.

In order to protect the compact the methodology of the present disclosure includes coating required surfaces of the compact, especially the surface of the substrate, with a plurality of different coatings or layers. The layers can be applied to selected portions of or the entirety of the compact, as will be described further herein.

To prevent the leaching chemical agent from leaking through possible pin-holes or pores of the outer coatings, which will be described further herein, and attack the compact, a denser and continuously protective layer can be applied. Initially, in step 30 of FIG. 3, substrate 12 and the volume of diamond material 14 are coated with a protective pre-coating layer 40.

Pre-coating layer 40 can have a thickness of about 1 μm to about 100 μm and can be a layer of protective pre-coating of an organic material, for example, selected from a group of photoresist polymers or materials. For purposes herein, an organic material is defined as a poly(methyl methacrylate) PMMA or poly(methyl glutarimide) (PMGI)or compositions thereof. It should be appreciated that other materials for the coating can be used.

Figure 4:
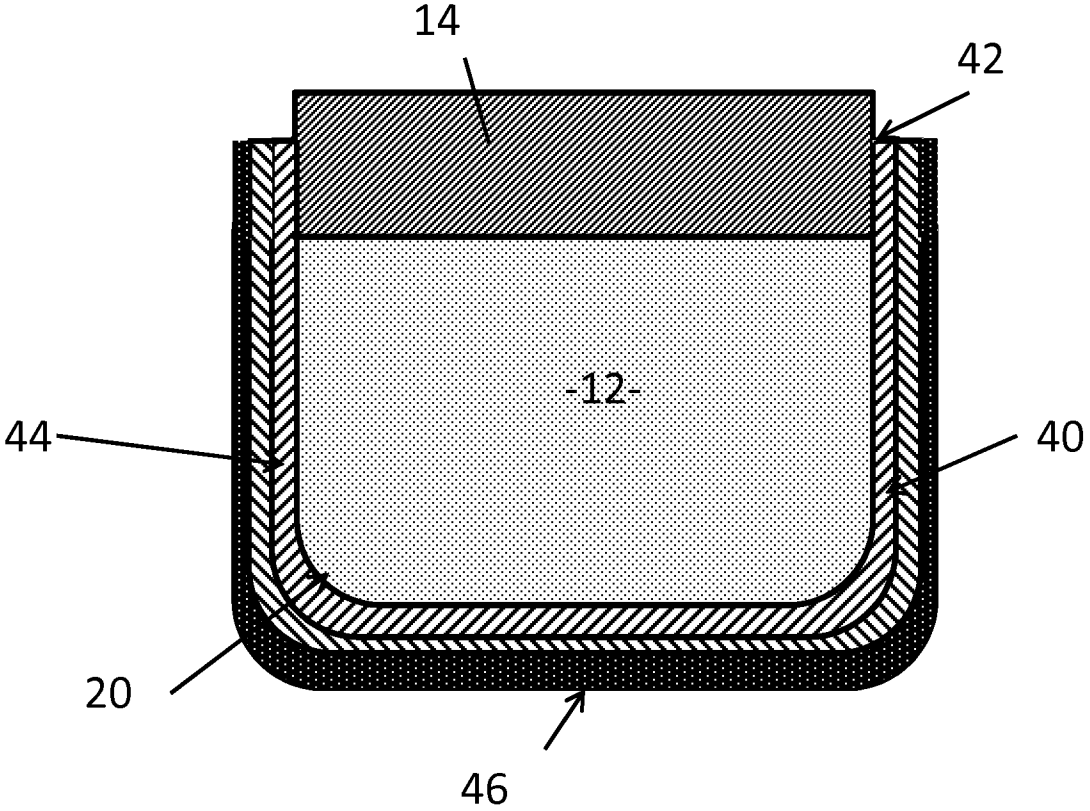
FIG. 4 is a cross-sectional view of a coated compact according to an embodiment of the present disclosure.
Figure 5B:
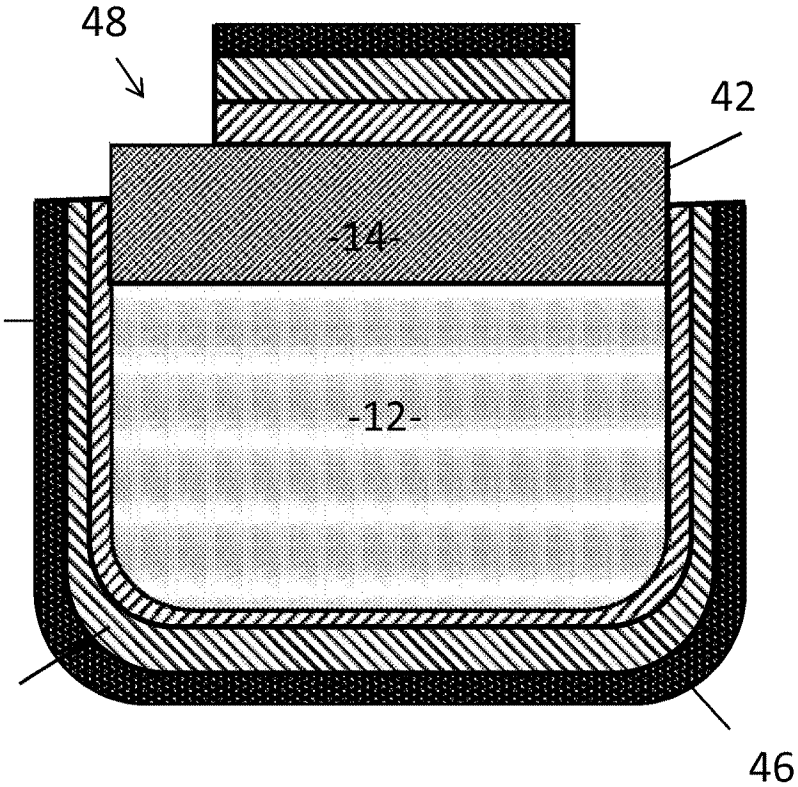
FIGS. 5(*a*)-(*b*) are cross-sectional views of a coated compact according to another embodiment of the present disclosure.
Figure 5A:
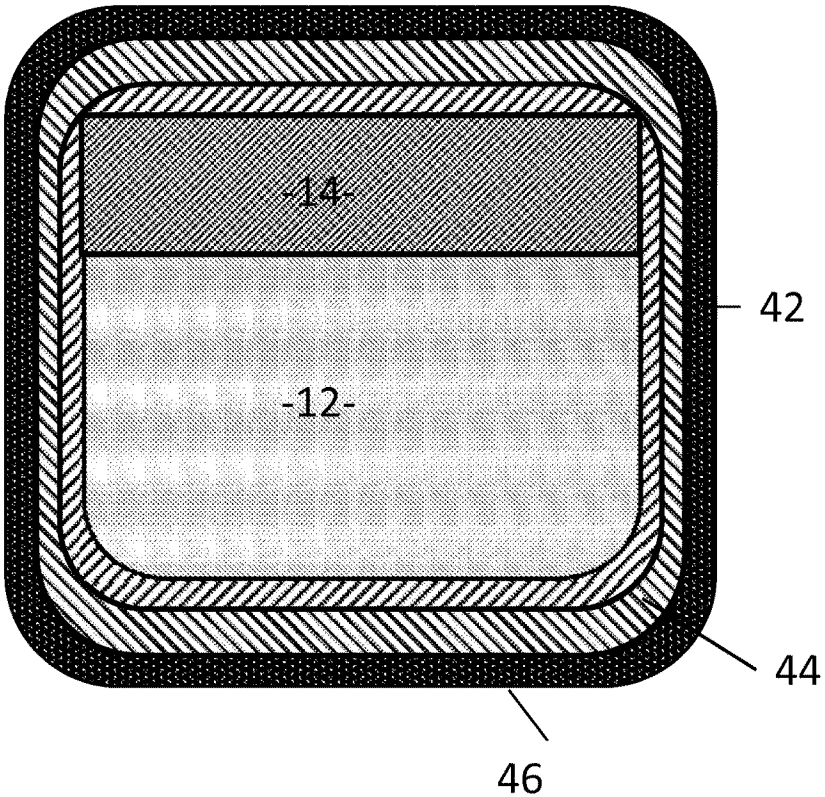

Pre-coating layer 40 can be applied to the entire surface 20 of substrate 12 and/or selected portions 42 of diamond material 14 as shown in FIG. 4 or over the entirety of substrate 12 and diamond volume 14 as shown in FIG. 5(*a*). The pre-coating can be applied by a variety of techniques, such as spray coating, spin coating, dip coating and other photo-resist methods.

After the step of applying pre-coating layer 40, at least one layer of a primer coating layer 44 can be applied to the compact. As shown at step 32 of FIG. 3 and in FIG. 4, primer layer 44 can be applied to the entire surface 20 of substrate 12 and to selected portions 42 of diamond volume 14 or over the entirety of substrate 12 and diamond volume 14 as shown in FIG. 5(*a*).

Although one layer is shown, a plurality of primer layers 44 can be applied. Each primer layer can have a thickness of about 1 μm to about 100 μm, such that the maximum thickness for all the coatings, including the top coat layer is at a total of minimum of least about 200 μm. Primer layer(s) can be a different polymer or PTFE or PFA based. The primer coating can be applied by a variety of techniques, such as spray coating, spin coating, dip coating and other photo-resist methods.

Referring again to FIG. 3, after the pre-coating and primer layers are applied to the substrate and diamond volume, an outer top coat layer can be applied in step 34. The layer of top coating is a coating of polymeric material selected from the group of polytetrafluoroethylene (PTFE) and perfluoroalkoxy (PFA) based polymers. As shown in FIGS. 4 and 5(*a*), top coating layer 46 can be applied to the entire surface 20 of substrate 12 and selected portions 42 of diamond volume 14 or the entire surface of the substrate 12 and entire surface of the diamond volume.

Top coating layer 46 can have a thickness of about 1 μm to about 100 μm and can be a flouro-polymer. The top coating can be applied by a variety of techniques, such as spray coating, spin coating, and dip coating methods. The total thickness of the pre-coat layer, the at least one primer layer and the top coat layer applied is a minimum of about 200 μm.

Referring to FIG. 5(*b*), if the entire surface of diamond volume 14 is coated with layers 42, 44 and 46 as described above, selected parts 48 of the coatings can be removed.

As shown in step 36 of FIG. 3, the coatings can be removed from part(s) 48 by scraping, cutting or abrading. Thus, leaching of the diamond volume material can occur as described below.

Referring now to step 38, the leaching process comprises immersing, soaking or spraying the coated PDC compact with a given acid or mixture of acids to leach the binder catalyst from the selected portions of the compact as described above. The most common acids used in this process are hydrochloric acid, nitric acid, hydrofluoric acid, sulfuric acid, hydrogen peroxide and various mixtures thereof.

Although trace amounts of the binder-catalyst material will remain in the volume of diamond material, a substantial portion of the binder catalyst will have been removed during the leaching process. However, the substrate material and properties thereof will remain unchanged due to the multiple layers of coating disposed thereon. It should also be appreciated that the amount of binder-catalyst removed is application driven and hence the specific acid or mixture used and the amount of time the compact is exposed to the given acid or mixture depends on the end use of the compact.

EXAMPLE

A protective fluoropolymer coating was provided on tungsten carbide (WC) substrates for leaching polycrystalline diamond (PCD) cutters. The PCD cutters were first cleaned with ethanol in an ultrasonic bath for 2-3 minutes and dried in air. Then the cutters were pre-heated at 200° C. for a period of 10-15 minutes. 50 ml of 857N-210 grade Topcoat Clear solution, containing PFA, from DuPont (Wilmington, Del.) was taken in a container attached with a micro nozzle spray. A detachable metal mask, 1 mm stainless steel with holes to match the diameter of the cutter, was used for not coating the diamond table of the cutter. The heated cutters were placed, with the diamond table facing down, on a plate with the masks covering the diamond tables. The Topcoat Clear solution was then spray coated, at room temperature, on the tungsten carbide substrate, while uniformly rotating the plate and the cutters. The sprayed cutters were then placed in a box furnace and the temperature was set at 400° C. for about 15 minutes. Once the heating cycle was complete and after the furnace is cooled down to 200° C., the coating process was repeated for a second layer. At the end of the second heating step, the carbide portion of the cutters were covered with a smooth and continuous layer of fluoropolymer resistant to leaching mineral acids at temperatures up to 130° C.

Although the present disclosure has been described in relation to particular embodiments thereof, many other variations and modifications and other uses will become apparent to those skilled in the art. It is preferred therefore, that the present disclosure be limited not by the specific disclosure herein, but only by the appended claims.

What is claimed is:

1. A polycrystalline diamond compact comprising:

a substrate of a hard metal composition of material, the substrate having an exterior surface;

a volume of diamond material disposed on the substrate;

at least one layer of a protective pre-coating of organic material impermeable to a given acid or mixture of given acids disposed on an entire exterior surface of the substrate and selected portions of the volume of diamond material;

at least one layer of primer material that is impermeable to a given acid or mixture of given acids disposed on the at least one protective pre-coating dispersed on the entire exterior surface of the substrate and selected portions of the volume of diamond material; and a layer of top coating material that is impermeable to the given acid or mixture of given acids disposed on the at least one primer material layer.

2. The polycrystalline diamond compact of claim 1, wherein the at least one protective pre-coating layer has a thickness of about 1 μm to about 100 μm.

3. The polycrystalline diamond compact of claim 1, wherein the at least one protective pre-coating layer is a coating of organic material selected from the group of photoresist polymers.

4. The polycrystalline diamond compact of claim 1, wherein the layer of top coating has a thickness of about 1 μm to about 100 μm.

5. The polycrystalline diamond compact of claim 1, wherein the layer of top coating is a coating of polymeric material selected from the group of polytetrafluoroethylene (PTFE) or perfluoroalkoxy (PFA) based polymers.

6. The polycrystalline diamond compact of claim 1, wherein the binder-catalyst is selected from the group of cobalt, silicon, boron, zirconium, aluminum, ruthenium, chromium, manganese, molybdenum, platinum, palladium and combination thereof.

7. The polycrystalline diamond compact of claim 1, wherein the hard composition of material is cemented carbide selected from the group of tungsten, silicon, chromium, vanadium, tantalum, niobium, titanium, nickel, cobalt, iron and combinations thereof.

8. The polycrystalline diamond compact of claim 1, wherein the at least one primer layer has a thickness of about 1 μm to about 100 μm.

9. The polycrystalline diamond compact of claim 1, wherein the at least one primer layer is a coating of polymeric material selected from the group of polytetrafluoroethylene (PTFE) or perfluoroalkoxy (PFA) based polymers.

10. The polycrystalline diamond compact of claim 1, wherein a total thickness of the pre-coat layer, the at least one primer layer and the top coat layer is at a minimum of about 200 μm.

11. A method for making a polycrystalline diamond compact comprising the steps of:

providing a polycrystalline diamond compact, the compact having a substrate of a hard metal composition of material and a volume of diamond material disposed on the substrate;

applying at least one pre-coating layer of organic material impermeable to a given acid or mixture of given acids to at least an exterior surface of the substrate;

applying at least one layer of primer material that is impermeable to a given acid or mixture of given acids on the at least one pre-coating layer; and applying a layer of top coating material that is impermeable to the given acid or mixture of given acids to the at least one primer layer.

12. The method of claim 11, wherein the binder-catalyst is selected from the group of cobalt, silicon, boron, zirconium, aluminum, ruthenium, chromium, manganese, molybdenum, platinum, palladium and mixtures of such.

13. The method of claim 11, wherein the hard composition of material is cemented carbide selected from the group of tungsten, silicon, chromium, vanadium, tantalum, niobium, titanium, nickel, cobalt, iron and combinations thereof.

14. The method of claim 11, wherein the at least one primer layer is applied in a thickness of about 1 μm to about 100 μm.

15. The method of claim 11, wherein the at least one primer layer is a coating of polymeric material selected from the group of polytetrafluoroethylene (PTFE) or perfluoroalkoxy (PFA) based polymers.

16. The method of claim 11, wherein the step of applying at least one primer layer comprises coating an entire surface of the substrate of the compact.

17. The method of claim 11, wherein the step of applying at least one primer layer comprises coating an entire surface of substrate of the compact with a plurality of primer layers of material.

18. The method of claim 11, wherein the step of applying at least one primer layer comprises coating an entire surface of the substrate and a portion of the volume of diamond material of the compact.

19. The method of claim 18, wherein the step of applying at least one primer layer comprises coating the entire surface of the substrate and a portion of the volume of diamond material of the compact with a plurality of layers of primer material.

20. The method of claim 11, wherein the step of applying at least one layer of primer material comprises coating the entire surface of the substrate and the volume of diamond material of the compact and further comprising the step of selectively removing a part of the coating from the volume of diamond material.

21. The method of claim 11, wherein the layer of top coating is applied in a thickness of about 1 μm to about 100 μm.

22. The method of claim 11, wherein the layer of top coating is a coating of polymeric material selected from the group of polytetrafluoroethylene (PTFE) or perfluoroalkoxy (PFA) based polymers.

23. The method of claim 11, wherein the step of applying the layer of top coating comprises coating an entire surface of the substrate and a portion of the volume of diamond material of the compact.

24. The method of claim 11, wherein the step of applying the layer of top coating comprises coating an entire surface of the substrate and volume of diamond material of the compact and further comprising the step of selectively removing a part of the top coating from the volume of diamond material.

25. The method of claim 11, further comprising the step of applying the given acid or mixture of given acids to the compact to leach the binder-catalyst from only the diamond material.

26. The method of claim 11, wherein the at least one protective pre-coating layer is a coating of organic material selected from the group of photoresist polymers.

27. The method of claim 11, wherein the at least one protective pre-coating layer is applied in a thickness of about 1 μm to about 100 μm.

28. The method of claim 11, wherein a total thickness of the pre-coat layer, the at least one primer layer and the top coat layer applied is at a minimum of about 200 μm.

* * * * *